US009997168B2

(12) United States Patent
Hsu

(10) Patent No.: US 9,997,168 B2
(45) Date of Patent: Jun. 12, 2018

(54) METHOD AND APPARATUS FOR SIGNAL EXTRACTION OF AUDIO SIGNAL

(71) Applicant: Novatek Microelectronics Corp., Hsinchu OT (TW)

(72) Inventor: Chung-Chi Hsu, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 274 days.

(21) Appl. No.: 14/798,469

(22) Filed: Jul. 14, 2015

(65) Prior Publication Data

US 2016/0322064 A1 Nov. 3, 2016

(30) Foreign Application Priority Data

Apr. 30, 2015 (TW) ..... 104113927 A

(51) Int. Cl.

| | |
|---|---|
| ***G10L 21/00*** | (2013.01) |
| ***G10L 21/0208*** | (2013.01) |
| *G10L 25/18* | (2013.01) |
| *G10L 21/0232* | (2013.01) |

(52) U.S. Cl.

CPC ..... *G10L 21/0208* (2013.01); *G10L 21/0232* (2013.01); *G10L 25/18* (2013.01)

(58) Field of Classification Search

CPC . G01L 21/0232; G01L 21/0216; G01L 25/84; G01L 21/0208; G01L 25/18; G01L 21/02; G01L 15/20; G01L 19/005; G01L 2021/03643; G01L 25/78; G01L 25/24; G01L 2021/02085; G01L 2021/02168; G01L 21/0264; G01L 25/12; G01L 13/04; G01L 19/0204; G01L 19/087; G01L 2021/0135; G01L 15/26; G01L 19/12; G01L 2021/02087; G01L 2021/02166; G01L 2025/932; G01L 2025/937;

(Continued)

(56) References Cited

U.S. PATENT DOCUMENTS

| | | | | |
|---|---|---|---|---|
| 6,001,131 | A * | 12/1999 | Raman | G10L 21/0208 704/226 |
| 7,742,914 | B2 | 6/2010 | Kosek et al. | |
| 7,912,567 | B2 | 3/2011 | Chhatwal et al. | |

(Continued)

FOREIGN PATENT DOCUMENTS

| | | |
|---|---|---|
| TW | 454168 | 9/2001 |
| TW | 533406 | 5/2003 |

(Continued)

OTHER PUBLICATIONS

"Office Action of Taiwan Counterpart Application", dated Jul. 20, 2016, p. 1-p. 4, in which the listed references were cited.

*Primary Examiner* — Abdelali Serrou
(74) *Attorney, Agent, or Firm* — JCIPRNET

(57) ABSTRACT

A method and an apparatus for signal extraction of audio signal are provided. An audio signal is converted into a plurality of frames, and the frames are arranged in a chronological order. Spectral data of each of the frames is obtained. The spectral data of each of N frames is extracted in the chronological order, and a spectral connectivity operation is executed for the N frames. Finally, the signal including the frames having the spectral connectivity between adjacent frames in each of the frames is determined as an ideal signal.

15 Claims, 4 Drawing Sheets

(58) Field of Classification Search
CPC ... G01L 21/028; G01L 21/0308; G01L 25/00; G01L 25/27; G01L 25/87
See application file for complete search history.

(56) References Cited

U.S. PATENT DOCUMENTS 8,355,908 B2 1/2013 Yamabe et al.
8,831,121 B1 * 9/2014 Qi ..... H04B 1/0067 375/260
9,666,210 B2 * 5/2017 Norvell ..... G10L 25/18
2001/0021905 A1 * 9/2001 Burnett ..... A61B 5/0507 704/233
2004/0098257 A1 * 5/2004 Katsuya ..... G10L 19/005 704/226
2005/0114128 A1 * 5/2005 Hetherington ..... G10L 21/0208 704/233
2006/0100867 A1 * 5/2006 Lee ..... G10L 21/0208 704/226
2006/0130637 A1 * 6/2006 Crebouw ..... G10L 19/0204 84/603
2006/0184363 A1 * 8/2006 McCree ..... G10L 21/0208 704/233
2006/0200344 A1 * 9/2006 Kosek ..... G10L 21/0208 704/226
2008/0019538 A1 * 1/2008 Kushner ..... A62B 18/08 381/94.1
2008/0052067 A1 * 2/2008 Morito ..... G10L 21/0208 704/226
2008/0118082 A1 * 5/2008 Seltzer ..... G10L 21/0208 381/94.1
2009/0177466 A1 * 7/2009 Rui ..... G10L 21/0208 704/225
2010/0179808 A1 * 7/2010 Brown ..... G10L 21/0208 704/225
2010/0260354 A1 * 10/2010 Ozawa ..... G10L 21/0208 381/94.4
2010/0296665 A1 * 11/2010 Ishikawa ..... G10L 21/0208 381/71.1
2011/0238418 A1 * 9/2011 Wang ..... G10L 21/0208 704/233
2011/0301945 A1 * 12/2011 Ichikawa ..... G10L 15/20 704/211
2012/0022863 A1 * 1/2012 Cho ..... G10L 15/14 704/233
2012/0053933 A1 * 3/2012 Tamura ..... G10L 13/04 704/207
2012/0265534 A1 * 10/2012 Coorman ..... G10L 13/033 704/265
2013/0054234 A1 * 2/2013 Kim ..... G10L 21/0208 704/226
2013/0294614 A1 * 11/2013 Bharitkar ..... H04M 9/082 381/71.1
2014/0270252 A1 * 9/2014 Pahuja ..... G10L 21/0208 381/94.5
2014/0350927 A1 * 11/2014 Yamabe ..... G10L 21/0232 704/233
2015/0071463 A1 * 3/2015 Niemisto ..... G10L 21/0224 381/94.5
2015/0081287 A1 * 3/2015 Elfenbein ..... G10L 21/0208 704/226

FOREIGN PATENT DOCUMENTS

TW 200531006 A 9/2005
TW 200941456 A 10/2009

* cited by examiner

METHOD AND APPARATUS FOR SIGNAL EXTRACTION OF AUDIO SIGNAL

CROSS-REFERENCE TO RELATED APPLICATION

This application claims the priority benefit of Taiwan application serial no. 104113927, filed on Apr. 30, 2015. The entirety of the above-mentioned patent application is hereby incorporated by reference herein and made a part of this specification.

BACKGROUND OF THE INVENTION

Field of the Invention

The invention relates to a method and an apparatus for processing audio signal, and more particularly, to a method and an apparatus for signal extraction of audio signal.

Description of Related Art

Generally, during a processing procedure of an audio signal such as voice or music, an ideal signal is maintained in the audio signal and a noise is removed from the audio signal. Ideal signal and noise segmentation may include a noise detection method and a signal extraction method. The noise detection method includes the following methods: an energy detection method using amplitude, power spectral density (PSD), zero crossing rate (ZCR) or the like; a model comparison method using Probability Model, Spectrum Model, Likelihood or the like; an auto convergence method using least mean square (LMS), normalized least mean square (NLMS) or the like; and an adaptability estimation method using Adaptive Filter, Moving Average, linear predictive coding (LPC) or the like.

Among them, the energy detection method and the model comparison method usually distinguishes the ideal signal from the noise on the time axis. The auto convergence method is incapable of separating frequency bands of the ideal signal and the noise for further analysis. As for the adaptability estimation method, the estimation may be inaccurate when the signal-to-noise ratio (SNR) is low.

In addition, the methods using signal extraction (including spectrogram 2D masking, signal model comparison, etc.) mostly belong to determination and identification for the known signal types. Those methods can only extract the expected signal types and may consume a lot of resources if there are too many signal types.

SUMMARY OF THE INVENTION

The invention is directed to a method and an apparatus for signal extraction of audio signal, which are capable of rapidly extracting the ideal signal in the audio signal.

The method for signal extraction of audio signal of the present invention includes the following steps. An audio signal is converted into a plurality of frames, and the frames are arranged in a chronological order. Spectral data of each of the frames is obtained. The spectral data of each of continuous N frames extracted from a current frame to a $N^{th}$ frame in the chronological order is extracted by using each of the frames as the current frame, and a spectral connectivity operation is executed for the N frames. The step of executing the spectral connectivity operation includes: obtaining a signal block list of each of the N frames based on the spectral data included in each of the N frames, wherein the signal block list records a frequency index range having a signal value; and searching for a spectral connectivity between adjacent frames according to the signal block list of each of the N frames. Finally, the signal including the frames having the spectral connectivity between the adjacent frames in each of the frames is determined as an ideal signal.

The apparatus for signal extraction of audio signal of the invention includes a processing unit and a storage unit. The storage unit is coupled to the processing unit and includes a plurality of modules. The processing unit drives the modules to detect an ideal signal in an audio signal. Aforesaid modules include a converting module and an operation module. The converting module is configured to convert the audio signal into a plurality of frames, wherein the frames are arranged in a chronological order. The operation module is configured to obtain spectral data of each of the frames, extract the spectral data of each of continuous N frames extracted from a current frame to a $N^{th}$ frame in the chronological order by separately using each of the frames as the current frame, and execute a spectral connectivity operation for the N frames. The spectral connectivity operation includes: obtaining a signal block list of each of the N frames based on the spectral data included in each of the N frames, wherein the signal block list records a frequency index range having a signal value; searching for a spectral connectivity between adjacent frames according to the signal block list of each of the N frames; and determining a signal including the frames having the spectral connectivity between the adjacent frames in each of the frames as an ideal signal.

Based on the above, the spectral connectivity operation may be executed to locate connected signal blocks. As such, by eliminating temporal signals isolated in small blocks of a spectrum, the ideal signal and the noise may be rapidly distinguished.

To make the above features and advantages of the present disclosure more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
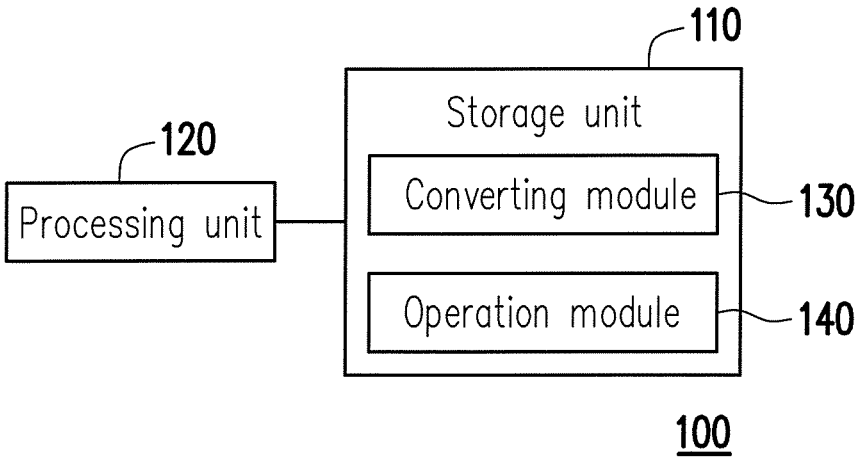
FIG. 1 is a block diagram illustrating an apparatus for signal extraction of audio signal according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a block diagram illustrating an apparatus for signal extraction of audio signal according to an embodiment of the invention. An apparatus for signal extraction 100 includes a storage unit 110 and a processing unit 120. The processing unit 120 is coupled to the storage unit 110. The processing unit 120 is, for example, a central processing unit (CPU), a programmable microprocessor, or an embedded control chip and the like.

The storage unit 110 is, for example, a fixed or a movable device in any possible forms including a random access memory (RAM), a read-only memory (ROM), a flash memory, a hard drive or other similar devices, or a combination of the above-mentioned devices. Multiple program code segments are stored in the storage unit 110, and after the program code segments are installed, the processing unit 120 may execute the program code segments to perform a method for signal extraction of audio signal, so as to rapidly and accurately extract the ideal signal in the audio signal. The storage unit 110 is capable of storing the audio signal as well as various values and data required or generated by the method for signal extraction.

Herein, the audio signal is, for example, a digital signal generated from an original audio signal in an analog signal format processed by an analog-to-digital conversion. The original audio signal may be a voice command of users received by a microphone, or a signal sent by electronic apparatuses such as a television, a multimedia play and the like. The noise is, for example, a background white noise or a colored noise (e.g., a red noise, etc.) having stronger amplitude in a specific frequency segment.

The storage unit 110 includes a converting module 130 and an operation module 140. The converting module 130 and the operation module 140 in the storage unit 110 may be driven by the processing unit 120 in order to realize the method for signal extraction of audio signal. The converting module 130 is configured to convert the audio signal into a plurality of frames, and the frames are arranged in a chronological order. The operation module 140 is configured to search each of the frames for a spectral connectivity between adjacent frames, so as to determine a signal including the frames having the spectral connectivity as the ideal signal.

Further, in other embodiments, the converting module 130 and the operation module 140 may also be realized by using processors. That is to say, multiple processors may be used to realize functions of the converting module 130 and the operation module 140, respectively.

Figure 2:
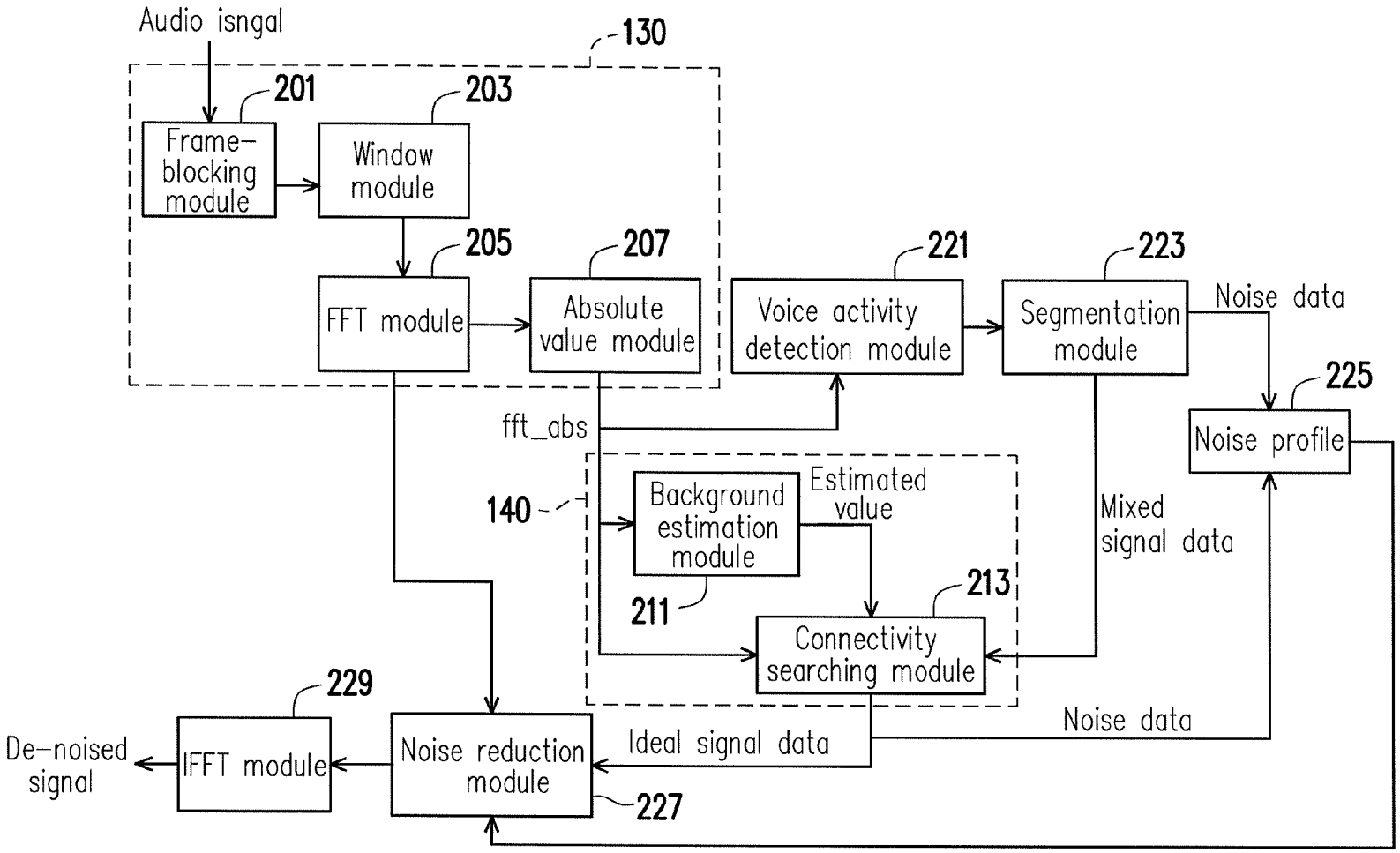
FIG. 2 is a schematic diagram illustrating a method for separating the ideal signal from the noise according to an embodiment of the invention.

One of implementations of the apparatus for signal extraction 100 is provided below as an example, but the invention is not limited thereto. FIG. 2 is a schematic diagram illustrating a method for separating the ideal signal from the noise according to an embodiment of the invention. Herein, the ideal signal refers to the signal having the spectral connectivity.

Referring to FIG. 1 and FIG. 2, in the present embodiment, the converting module 130 includes a frame-blocking module 201, a window module 203, a Fast Fourier Transform (FFT) module 205 and an absolute value module 207. The operation module 140 includes a background estimation module 211 and a connectivity searching module 213.

The frame-blocking module 201 is configured to convert the audio signal into a plurality of frames. The frame-blocking module 201 gathers an M number of sampling points together as one observation unit, which is known as the frame. In order to avoid excessive variation between two adjacent frames, an overlapping area is set between the two adjacent frames. The overlapping area includes an I number of the sampling points, and a value of I may usually be ½ or ⅓ of M, but not limited to be ½ or ⅓. In general, a sampling frequency for the frames used by the signal processing is 8 kHz or 16 kHz.

The window module 203 is configured to multiply each of the frames by one window function. Because the original audio signal is forced to be cut off by the frames, errors may occur when the Fourier transform is used to analyze the frequency. To avoid the errors generated by performing the Fourier transform, before the Fourier transform is performed, the frame may be multiplied by one window function increase a continuity between a left-end and a right-end of the frame. Herein, the window function is, for example, the Hamming window or the Hann window.

The fast Fourier transform (FFT) module (hereinafter, referred to as the FFT module) 205 is configured to transform the frame from a time domain into a frequency domain. That is to say, after multiplying the frame by the window function, each of the frames must be processed by the FFT module 205 to obtain an energy distribution in terms of frequency spectrum. The frequency spectrum obtained by the FFT module 205 includes a plurality of frequency spectrum components, and each of the frequency spectrum components includes a real part and an imaginary part. Therefore, the absolute value module 207 is further used to obtain an absolute value of each of the frequency spectrum components. For example, the absolute value module 207 may obtain the absolute value by calculating a square root of a total of a square of the real part and a square of the imaginary part, and use the absolute value as an amplitude of each of the frequency spectrum components. Herein, a result obtained by the absolute value module 207 is known as a frequency domain signal fft_abs.

After obtaining the frequency domain signal fft_abs, the background estimation module 211 executes a short time background estimation method for the frequency domain signal fft_abs to obtain an estimated value. Thereafter, based on the estimated value, the connectivity searching module 213 executes a filtering action for the frequency domain signal fft_abs to obtain the spectral data of the frame. For example, a signal value less than or equal to the estimated value in the frequency domain signal fft_abs is filtered out and only the signal value greater than the estimated value is maintained.

A voice activity detection (VAD) module 221 and a segmentation module 223 are optional components. The VAD module 221 and the segmentation module 223 may be used to further improve accuracy and speed of signal extraction, and yet the noise may still be detected without using the VAD module 221 and the segmentation module 223. Whether the audio signal is the noise may be determined by the VAD module 221. If it is the noise being determined, the segmentation module 223 may determine the signal as noise data; otherwise, the signal is determined as mixed signal data. The segmentation module 223 transmits the noise data to a noise profile 225 for updating, and transmits the mixed signal data (a result of the voice activity detection) to the connectivity searching module 213 of the operation module 140.

Because the ideal signal refers to the frames included in the signal having the spectral connectivity, it is required to locate the ideal signal according to whether there are connected spectra in the mixed signal data. Accordingly, the connectivity searching module 213 may further execute operations of signal extraction for the frequency domain signal fft_abs according to the result of the voice activity detection from the VAD module 221 and the estimated value. In other embodiments, the connectivity searching module 213 may also execute the signal extraction for the frequency domain signal fft_abs according to only the estimated value. After the spectral data of each of the frames is obtained, the connectivity searching module 213 may proceed to search for the spectral connectivity (related description thereof will be provided later). After the signals belonging to the ideal signal in the frame are determined, the connectivity searching module 213 regards those signals not belonging to the ideal signal as the noise data and transmits the noise data to the noise profile 225 for updating.

A noise reduction module 227 performs a noise reduction for the signals outputted by the FFT module 205 according to the noise profile 225 and the output of the connectivity searching module 213. Thereafter, an inverse fast Fourier transform (IFFT) module 229 performs an IFFT operation for the output of the noise reduction module 227 to convert the frame from the frequency domain into the time domain, so as to obtain a de-noised signal.

Detailed descriptions regarding the noise detection are provided as follows.

Figure 3:
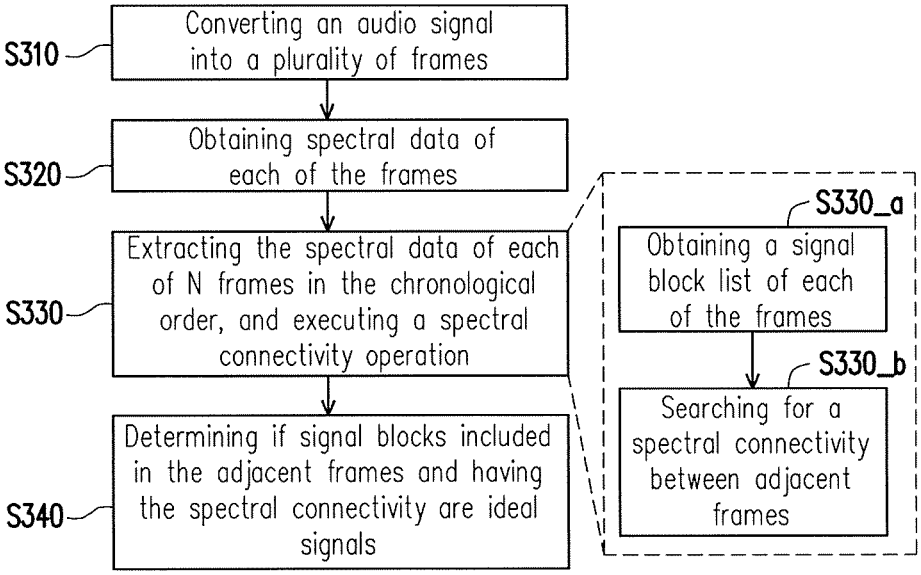
FIG. 3 is a flowchart illustrating a method for signal extraction of audio signal according to an embodiment of the invention.

FIG. 3 is a flowchart illustrating a method for signal extraction of audio signal according to an embodiment of the invention. Referring to FIG. 1 to FIG. 3, in step S310, the converting module 130 converts an audio signal into a plurality of frames, and the frames are arranged in a chronological order. For example, the frames may be obtained through the frame-blocking module 201, and then the frequency domain signal fft_abs of each of the frames may be obtained through the window module 203, the FFT module 205 and the absolute value module 207.

Next, in step S320, the operation module 140 obtains spectral data of each of the frames. For example, the operation module 140 executes the short time background estimation method through the background estimation module 211, and obtains the spectral data of each of the frames in the frequency domain through the connectivity searching module 213 according to an outputted result from the background estimation module 211. Herein, the spectral data is data based on a frequency index. The connectivity searching module 213 may convert each of the frequency domain signal fft_abs of a corresponding frequency index into "with signal value" or "without signal value" states according to an estimated value. For example, the signal value less than or equal to the estimated value in the frequency domain signal fft_abs may be filtered out (i.e. regarded as "without signal value") and only the signal value greater than the estimated value are maintained (regarded as "with signal value") according to the estimated value obtained by the background estimation module 211.

Figure 4:
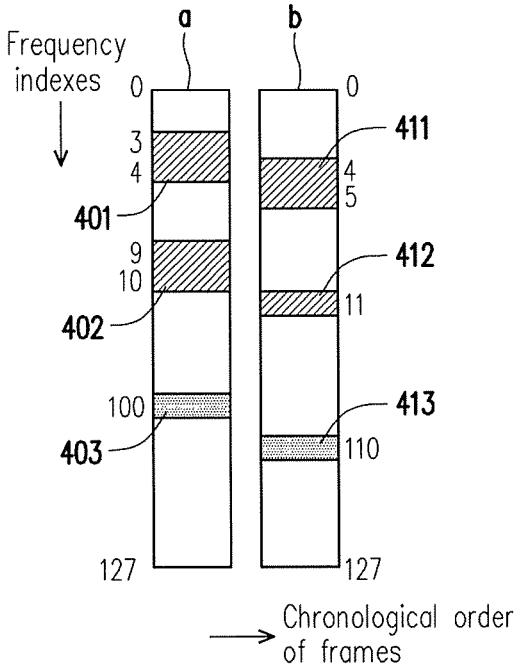
FIG. 4 is a schematic diagram of spectral data of two adjacent frames according to an embodiment of the invention.

For instance, FIG. 4 is a schematic diagram of spectral data of two adjacent frames according to an embodiment of the invention. Herein, FIG. 4 shows the spectral data of frames a and b which are adjacent to each other in the chronological order. In the frame a, frequency index ranges 401, 402 and 403 have the signal value. In the frame b, frequency index ranges 411, 412 and 413 have the signal value. Herein, the frequency indexes are represented by 0 to 127.

Referring back to FIG. 3, after the spectral data is obtained, in step S330, the operation module 140 extracts the spectral data of each of continuous N frames extracted from a current frame to a $N^{th}$ frame in the chronological order by separately using each of the frames as the current frame and executes a spectral connectivity operation for the N frames through the connectivity searching module 213. That is to say, the connectivity searching module 213 performs sampling by shifting one frame each time, and once extracts the N frames continuously in time to determine the spectral connectivity among the N frames.

The step S330 includes step S330_*a* and step S330_*b*. In step S330_*a*, the connectivity searching module 213 first obtains a signal block list of each of the frames based on the spectral data included in each of the extracted N frames. The signal block list records a frequency index range having a signal value. For the frame a in FIG. 4, a starting point and an ending point of each of the frequency index ranges 401, 402 and 403 are recorded in the signal block list of the frame a. For example, because the starting point is the frequency index 3 and the ending point is the frequency index 4 in the frequency index range 401, the frequency index range 401 may be represented by [3,4]. By analogy, the frequency indexes 402 and 403 are represented by [9,10] and [100, 100], respectively.

Subsequently, in step S330_*b*, the connectivity searching module 213 searches for a spectral connectivity between each frame and its adjacent frame according to the signal block list of each of the frames. The so-called spectral connectivity refers to signal blocks included in multiple successively adjacent frames and having overlapping or connected ranges in terms of the frequency indexes, wherein the number of the successively adjacent frames is an integer greater than or equal to 2. In view of FIG. 4, taking the spectral connectivity between the two successively adjacent frames as an example, because the frequency index range 401 ([3,4]) of the frame a and the frequency index range 411 ([4,5]) of the frame b have an overlapping portion, these two frequency index ranges have the spectral connectivity. As another example, because the frequency index range 402 ([9,10]) of the frame a and the frequency index range 412 ([11,11]) of the frame b are connected, these two frequency index ranges also have the spectral connectivity. On the other hands, because the frequency index range 403 ([100, 100]) of the frame a and the frequency index range 413 ([110,110]) of the frame b are neither overlapped nor connected, these two frequency index ranges do not have the spectral connectivity.

Thereafter, in step S340, the connectivity searching module 213 of the operation module 140 determines signal blocks, which are included in the adjacent frames and have the spectral connectivity, as ideal signals. In other words, signal blocks (i.e., frequency index ranges having signal values greater than the estimated value), which are included in the adjacent frames and do not have the spectral connectivity, are determined as the noise. Take FIG. 4 as an example, the frequency index range 403 of the frame a and the frequency index range 413 of the frame b will be determined as the noise.

Another example is provided below to describe one of application examples for the spectral connectivity operation in more details.

Figure 5:
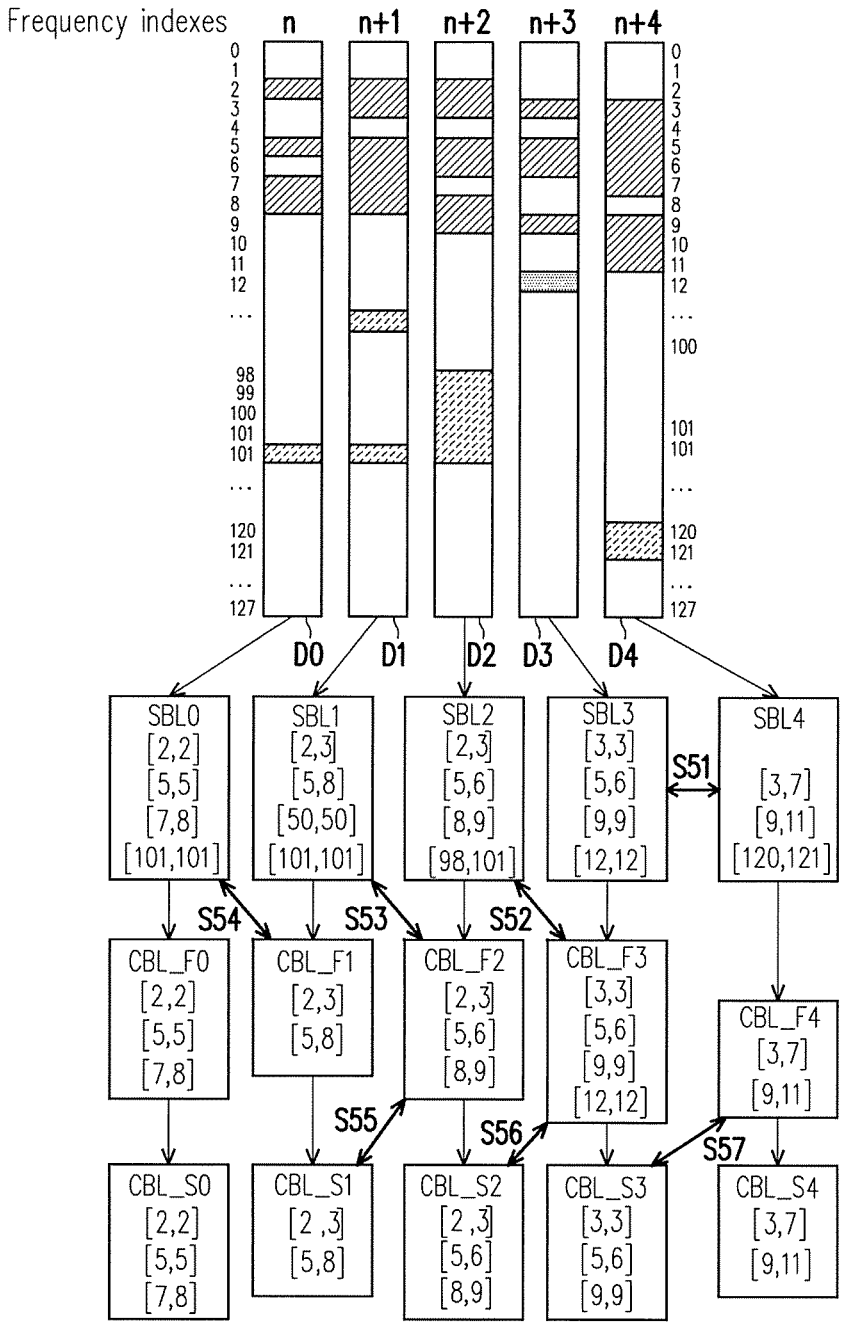
FIG. 5 is a schematic diagram of a spectral connectivity operation according to an embodiment of the invention.

FIG. 5 is a schematic diagram of a spectral connectivity operation according to an embodiment of the invention. In the present embodiment, the connectivity searching module 213 extracts N frames for execution each time by using each of the frames one by one as a current frame, where N=5. That is, first of all, a first frame is used as the current frame, and the $1^{st}$ frame to the $5^{th}$ frame are extracted for executing the spectral connectivity operation; next, a second frame is used as the current frame, and the $2^{nd}$ frame to the $6^{th}$ frame are extracted for executing the spectral connectivity operation; and then, a third frame is used as the current frame, and the $3^{rd}$ frame to the $7^{th}$ frame are extracted for executing the spectral connectivity operation. Accordingly, except for the first frame, the spectral connectivity operation is executed more than twice for each of the other frames. In the present embodiment, because N is 5, starting from the fifth frame, the spectral connectivity operation is executed five times for each of the frames. Herein, although the spectral connectivity operation executed each time is described by using FIG. 5 as an example, the invention is not limited thereto.

Description below is provided to specifically describe the specific spectral connectivity operation being executed once for the extracted 5 frames (a frame n to a frame n+4). The connectivity searching module 213 first extracts spectral data D0 to D4 of the frame n to the frame n+4. Subsequently, the connectivity searching module 213 obtains signal block lists SBL0 to SBL4 of the frames based on the spectral data D0 to D4 included in the frame n to the frame n+4. For the spectral data D0, there are the signal values respectively at the frequency indexes 2, 5, 7 to 8, and 101. Accordingly, the signal block list SBL0 includes the frequency index ranges [2,2], [5,5], [7,8], and [101,101], and the rest may be deduced by analogy. As a result, the signal block lists SBL0 to SBL4 of the frame n to the frame n+4 are obtained. Thereafter, the connectivity searching module 213 may search each frame for the spectral connectivity between the adjacent frames according to the signal block lists SBL0 to SBL4.

Specifically, the connectivity searching module 213 searches for the spectral connectivity between the continuous N frames in the chronological order from back to front according to the signal block list of each of the frames to obtain first connectivity block lists CBL_F0 to CBL_F4 of the 5 frames. The first connectivity block lists CBL_F0 to CBL_F4 record the frequency index ranges having the spectral connectivity among the N frames based on the search from back to front in the chronological order, and detailed description regarding the above may refer to step S51 to step S54 as provided below.

In step S51, the frame n+4 and its previous frame n+3 are searched for the spectral connectivity. First of all, the signal block list SBL4 and the signal block list SBL3 of the frame n+4 and the frame n+3 are compared to obtain the first connectivity block lists CBL_F4 and CBL_F3, respectively. In step S51, the frequency index range [120,121] in the signal block list SBL4 of the frame n+4 is filtered out to obtain the first connectivity block list CBL_F4. Meanwhile, in step S51, because the frequency index ranges in the signal block list SBL3 of the frame n+3 have the connectivities to the frequency index ranges in the signal block list SBL4 of the frame n+4, the first connectivity block list CBL_F3 is obtained without filtering out any frequency index ranges of the signal block list SBL3.

In step S52, the frame n+3 and its previous frame n+2 are searched for the spectral connectivity. The first connectivity block list CBL_F3 is already obtained by comparing the frame n+3 with the frame n+4, therefore, the first connectivity block list CBL_F3 of the frame n+3 is compared with the signal block list SBL2 of the frame n+2 to obtain the first connectivity block list CBL_F2. In step S52, the frequency index range [98,101] in the signal block list SBL2 of the frame n+2 is filtered out to obtain the first connectivity block list CBL_F2.

In step S53, the frame n+2 and its previous frame n+1 are searched for the spectral connectivity. The first connectivity block list CBL_F2 of the frame n+2 is compared with the signal block list SBL1 of the frame n+1 to obtain the first connectivity block list CBL_F1. In step S53, the frequency index ranges [50,50] and [101,101] in the signal block list SBL1 of the frame n+1 are filtered out to obtain the first connectivity block list CBL_F1.

In step S54, the frame n+1 and its previous frame n are searched for the spectral connectivity. The first connectivity block list CBL_F1 of the frame n+1 is compared with the signal block list SBL0 of the frame n to obtain the first connectivity block list CBL_F0. In step S54, the frequency index range [101,101] in the signal block list SBL0 of the frame n is filtered out to obtain the first connectivity block list CBL_F0.

After step S51 to step S54 are executed, the connectivity searching module 213 searches for the spectral connectivity among the N frames in the chronological order from front to back according to the first connectivity block lists CBL_F0 to CBL_F4 of the frames so as to obtain second connectivity block lists CBL_S0 to CBL_S4 of the frames. The second connectivity block lists CBL_F0 to CBL_S4 record the frequency index range having the spectral connectivity among the N frames based on the search from front to back in the chronological order, and detailed description regarding above may refer to step S55 to step S57 as provided below.

During the process for comparing the continuous N frames in the chronological order from front to back, since the frame n and the frame n+1 are already compared in step S54, the first connectivity block list CBL_F0 and the first connectivity block list CBL_F1 are directly used as the second connectivity block list CBL_S0 and the second connectivity block list CBL_S1 respectively.

Thereafter, in step S55, the frame n+1 and the frame n+2 are searched for the spectral connectivity. The second connectivity block list CBL_S1 of the frame n+1 is compared with the first connectivity block list CBL_F2 of the frame n+2 to obtain second connectivity block list CBL_S2 of the frame n+2.

In step S56, the frame n+2 and the frame n+3 are searched for the spectral connectivity. The second connectivity block list CBL_S2 of the frame n+2 is compared with the first connectivity block list CBL_F3 of the frame n+3 to obtain the second connectivity block list CBL_S3 of the frame n+3. In step S56, the frequency index range [12,12] in the first connectivity block list CBL_F3 of the frame n+3 is filtered out to obtain the second connectivity block list CBL_S3.

In step S57, the frame n+3 and the frame n+4 are searched for the spectral connectivity. The second connectivity block list CBL_S3 of the frame n+3 is compared with the first connectivity block list CBL_F4 of the frame n+4 to obtain the second connectivity block list CBL_S4 of the frame n+4.

By comparing in the chronological order from back to front before doing the same again from front to back, the signal having the spectral connectivity among the frames may be reliably located. In the examples provided in the present embodiment, the searching is performed in the chronological order from back to front before performing the searching in the chronological order from front to back. In other embodiments, the searching may also be performed in the chronological order from front to back before performing the searching in the chronological order from back to front, and the invention is not limited thereto.

Thereafter, the connectivity searching module 213 performs an OR logical operation for the frequency index ranges recorded in the second connectivity block list being obtained each time according to a number of times that each frame is extracted for executing the spectral connectivity operation (i.e., a number of times that step S330 is executed for each of the frames), so as to obtain a final connectivity block list. For example, if 5 frames are extracted each time for executing the spectral connectivity operation, starting from a fifth frame, the spectral connectivity operation is executed by five times for each of the frames. Accordingly, for example, the fifth frame has 5 corresponding second connectivity block lists. As such, the connectivity searching module 213 performs the OR logical operation for the frequency index ranges recorded in the 5 second connectivity block lists in order to obtain the final connectivity block list of the fifth frame.

After the final connectivity block list of each of the frames is obtained, the connectivity searching module 213 extracts the spectral data of each of the frames in the frequency domain according to the frequency index ranges recorded in the final connectivity block list of each of the frames, to obtain the signal having the spectral connectivity and determine the signal as the ideal signal.

In summary, based on the foregoing embodiments, the short time background estimation method is used to locate possible signal bands, and then the spectral connectivity operation may be executed to locate the connected signal blocks. As such, by eliminating temporal signals isolated in small blocks of frequency spectrum, the ideal signal and the noise may be rapidly distinguished.

Although the present disclosure has been described with reference to the above embodiments, it will be apparent to one of ordinary skill in the art that modifications to the described embodiments may be made without departing from the spirit of the disclosure. Accordingly, the scope of the disclosure will be defined by the attached claims and not by the above detailed descriptions.

What is claimed is:

1. A method for signal extraction of audio signal, comprising:

converting an audio signal into a plurality of frames, wherein the frames are arranged in a chronological order;

obtaining frequency domain signal of each of the frames;

extracting the spectral data of each of continuous N frames extracted from a current frame to a $N^{th}$ frame in the chronological order by separately using each of the frames as the current frame, wherein extracting the spectral data of each of the frame comprises executing a filtering action on the frequency domain signal to filter out signal values which are less than or equal to an estimated value in the frequency domain signal and maintain signal values which are greater than the estimated value to be as the spectral data of the frame;

executing a spectral connectivity determining operation for the N frames, wherein the spectral connectivity determining operation comprises:

obtaining a signal block list of each of the N frames based on the spectral data included in each of the N frames, wherein the signal block list records one or more frequency index ranges having signal values greater than an estimated value and each frequency index range recorded in the signal block list represents a respective signal block in the frame; and searching for a spectral connectivity between two adjacent frames according to each of the frequency index ranges recorded in the signal block list of each of the adjacent frames, wherein when a frequency index range of a signal block of the first frame of the adjacent frames is overlapping with the other frequency index range of a signal block of a second frame of the adjacent frames or is connected to the other frequency index range of a signal block of the second frame, the two frequency index ranges have the spectral connectivity is determined;

determining the signal blocks included in the adjacent frames and having the spectral connectivity as ideal signals; and determining the signal blocks included in the adjacent frames and not having the spectral connectivity as noises;

performing a noise reduction operation on the frequency domain signal according to the ideal signals and the noises;

converting the output of the noise reduction operation from frequency domain into time domain by performing an inverse Fourier transform operation, and outputting a de-noised signal as an analog signal.

2. The method for signal extraction of audio signal according to claim 1, wherein the step of searching for the spectral connectivity between the adjacent frames according to the signal block list of each of the adjacent frames comprises:

searching for the spectral connectivity among the N frames in the chronological order from back to front according to the signal block list of each of the N frames so as to obtain a first connectivity block list of each of the N frames, wherein the first connectivity block list records the frequency index range having the spectral connectivity among the N frames in the chronological order from back to front; and searching for the spectral connectivity among the N frames in the chronological order from front to back according to the first connectivity block list of each of the N frames so as to obtain a second connectivity block list of each of the N frames, wherein the second connectivity block list records the frequency index range having the spectral connectivity among the N frames in the chronological order from front to back.

3. The method for signal extraction of audio signal according to claim 2, wherein the step of searching for the spectral connectivity among the N frames in the chronological order from back to front comprises:

comparing the signal block lists of the $N^{th}$ frame and an $(N-1)^{th}$ frame so as to obtain the first connectivity block lists of the $N^{th}$ frame and the $(N-1)^{th}$ frame; and comparing the first connectivity block list of a $j^{th}$ frame with the signal block list of a $(j-1)^{th}$ frame so as to obtain the first connectivity block list of the $(j-1)^{th}$ frame, wherein j is a positive integer and $2 \leq j \leq N-1$.

4. The method for signal extraction of audio signal according to claim 3, wherein the step of searching for the spectral connectivity among the N frames in the chronological order from front to back comprises:

setting the first connectivity block lists of a first frame and a second frame among the N frames as the second connectivity block lists of the first frame and the second frame, respectively; and comparing the second connectivity block list of a $k^{th}$ frame with the first connectivity block list of a $(k+1)^{th}$ frame so as to obtain the second connectivity block list of the $(k+1)^{th}$ frame, wherein k is a positive integer and $2 \leq k \leq N-1$.

5. The method for signal extraction of audio signal according to claim 2, wherein after the step of executing the spectral connectivity operation for the N frames, the method further comprises:

performing an OR logical operation for the frequency index ranges recorded in the second connectivity block list being obtained each time according to a number of times that each of the frames is extracted for executing the spectral connectivity operation, so as to obtain a final connectivity block list.

6. The method for signal extraction of audio signal according to claim 5, wherein the step of determining the signal blocks included in the adjacent frames having the spectral connectivity as the ideal signals comprises:

obtaining the signal blocks included in the adjacent frames having the spectral connectivity by extracting from the spectral data of each of the frames in a frequency domain according to the frequency index ranges recorded in the final connectivity block list of each of the frames, and determining the signal as the ideal signal.

7. The method for signal extraction of audio signal according to claim 1, wherein the step of obtaining the spectral data of each of the frames comprises:

converting each of the frames into a frequency domain signal;

executing a short time background estimation method for the frequency domain signal of each of the frames so as to obtain an estimated value; and executing a filtering action for the frequency domain signal based on the estimated value, so as to obtain the spectral data of each of the frames.

8. The method for signal extraction of audio signal according to claim 7, wherein the step of obtaining the spectral data of each of the frames further comprises:

executing a voice activity detection for the frequency domain signal of each of the frames; and executing the filtering action for the frequency domain signal based on a result of the voice activity detection and the estimated value, so as to obtain the spectral data of each of the frames.

9. An apparatus for signal extraction of audio signal, comprising:

a processor coupled to a storage unit and configured for:

converting the audio signal into a plurality of frames, wherein the frames are arranged in a chronological order; and obtaining frequency domain signal of each of the frames, extracting the spectral data of each of continuous N frames extracted from a current frame to a $N^{th}$ frame in the chronological order by separately using each of the frames as the current frame, wherein extracting the spectral data of each of the frame comprises executing a filtering action on the frequency domain signal to filter out signal values which are less than or equal to an estimated value in the frequency domain signal and maintain signal values which are greater than the estimated value to be as the spectral data of the frame; and executing a spectral connectivity determining operation for the N frames, wherein the spectral connectivity determining operation comprises: obtaining a signal block list of each of the N frames based on the spectral data included in each of the N frames, wherein the signal block list records one or more frequency index ranges having signal values greater than an estimated value and each frequency index range recorded in the signal block list represents a respective signal block in the frame; and searching for a spectral connectivity between two adjacent frames according to each of the frequency index ranges recorded in the signal block list of each of the adjacent frames, wherein when a frequency index range of a signal block of the first frame of the adjacent frames is overlapping with the other frequency index range of a signal block of a second frame of the adjacent frames or is connected to the other frequency index range of a signal block of the second frame, the two frequency index ranges have the spectral connectivity is determined; determining the signal blocks included in the adjacent frames and having the spectral connectivity as ideal signals; determining the signal blocks included in the adjacent frames and not having the spectral connectivity as noises; performing a noise reduction operation on the frequency domain signal according to the ideal signals and the noises; and converting the output of the noise reduction operation from frequency domain into time domain by performing an inverse Fourier transform operation, and outputting a de-noised signal as an analog signal.

10. The apparatus for signal extraction of audio signal according to claim 9, wherein the processor is further configured for:

seaching for the spectral connectivity among the N frames in the chronological order from back to front according to the signal block list of each of the N frames so as to obtain a first connectivity block list of each of the N frames, wherein the first connectivity block list records the frequency index range having the spectral connectivity among the N frames in the chronological order from back to front; and searching for the spectral connectivity among the N frames in the chronological order from front to back according to the first connectivity block list of each of the N frames so as to obtain a second connectivity block list of each of the N frames, wherein the second connectivity block list records the frequency index range having the spectral connectivity among the N frames in the chronological order from front to back.

11. The apparatus for signal extraction of audio signal according to claim 10, wherein the processor is further configured for:

comparing the signal block lists of an $N^{th}$ frame and an $(N-1)^{th}$ frame so as to obtain the first connectivity block lists of the $N^{th}$ frame and the $(N-1)^{th}$ frame; and the operation module compares the first connectivity block list of a $j^{th}$ frame with the signal block list of a $(j-1)^{th}$ frame so as to obtain the first connectivity block list of the $(j-1)^{th}$ frame, wherein j is a positive integer and $2 \leq j \leq N-1$; and setting the first connectivity block lists of a first frame and a second frame among the N frames as the second connectivity block lists of the first frame and the second frame, respectively; and the operation module compares the second connectivity block list of a $k^{th}$ frame with the first connectivity block list of a $(k+1)^{th}$ frame so as to obtain the second connectivity block list of the $(k+1)^{th}$ frame, wherein k is a positive integer and $2 \leq k \leq N-1$.

12. The apparatus for signal extraction of audio signal according to claim 10, wherein the processor is further configured for: performing an OR logical operation for the frequency index ranges recorded in the second connectivity block list being obtained each time according to a number of times that each of the frames is extracted for executing the spectral connectivity operation, so as to obtain a final connectivity block list.

13. The apparatus for signal extraction of audio signal according to claim 12, wherein the processor is further configured for: obtaining the signal including the frames having the spectral connectivity by extracting from the spectral data of each of the frames in a frequency domain according to the frequency index ranges recorded in the final connectivity block list of each of the frames, and determine the signal as the ideal signal.

14. The apparatus for signal extraction of audio signal according to claim 9, wherein the processor is further configured for: converting each of the frames into a frequency domain signal;

executing a short time background estimation method for the frequency domain signal of each of the frames so as to obtain an estimated value;

executing a filtering action for the frequency domain signal based on the estimated value, so as to obtain the spectral data of each of the frames.

15. The apparatus for signal extraction of audio signal according to claim 14, wherein the processor is further configured for:

executing a voice activity detection for the frequency domain signal of each of the frames;

wherein the processor executes the filtering action for the frequency domain signal based on a result of the voice activity detection and the estimated value, so as to obtain the spectral data of each of the frames.

* * * * *